US010138017B2

(12) United States Patent
Weng

(10) Patent No.: US 10,138,017 B2
(45) Date of Patent: Nov. 27, 2018

(54) LOADED PALLET CONTAINER

(71) Applicant: Ningbo Landprofit Fareast Imp&Exp Co., Ltd, Ningbo (CN)

(72) Inventor: XinYue Weng, Ningbo (CN)

(73) Assignee: NINGBO LANDPROFIT FAREAST IMO & EXP CO., LTD., Ningbo (CN)

( * ) Notice: Subject to any disclaimer, the term of this patent is extended or adjusted under 35 U.S.C. 154(b) by 395 days.

(21) Appl. No.: 14/940,649

(22) Filed: Nov. 13, 2015

(65) Prior Publication Data

US 2016/0137343 A1 May 19, 2016

(30) Foreign Application Priority Data

Nov. 17, 2014 (CN) ..... 2014 1 0649108

(51) Int. Cl.

*B65D 19/06* (2006.01)
*B65D 19/08* (2006.01)
*B65D 19/42* (2006.01)

(52) U.S. Cl.

CPC ..... *B65D 19/06* (2013.01); *B65D 19/08* (2013.01); *B65D 19/42* (2013.01); *B65D 2519/00024* (2013.01); *B65D 2519/00059* (2013.01); *B65D 2519/00094* (2013.01); *B65D 2519/00164* (2013.01); *B65D 2519/00199* (2013.01); *B65D 2519/00268* (2013.01); *B65D 2519/00288* (2013.01); *B65D 2519/00318* (2013.01); *B65D 2519/00333* (2013.01); *B65D 2519/00373* (2013.01); *B65D 2519/00497* (2013.01); *B65D 2519/00537* (2013.01); *B65D 2519/00572* (2013.01); *B65D 2519/00611* (2013.01);

(Continued)

(58) Field of Classification Search

CPC ..... B65D 19/06; B65D 19/08; B65D 19/40; B65D 19/42; B65D 2519/00288; B65D 2519/00318; B65D 2519/00497

USPC ..... 206/386, 1.5; 220/326, 811, 816, 812, 220/820, 824, 324, 315; 16/357, 361

See application file for complete search history.

(56) References Cited

U.S. PATENT DOCUMENTS 2,936,094 A * 5/1960 Smith ..... H01M 2/1072 220/315
4,887,537 A * 12/1989 Kellogg ..... B65D 19/44 108/55.1

(Continued)

FOREIGN PATENT DOCUMENTS

CN 203714508 7/2014

*Primary Examiner* — Steven A. Reynolds
(74) *Attorney, Agent, or Firm* — Hamre, Schumann, Mueller & Larson, P.C.

(57) ABSTRACT

A loaded pallet container includes a rectangular container body soleplate, a cover, a horizontal rotating shaft, a front enclosure plate, a rear enclosure plate, a left enclosure plate, and a right enclosure plate. A rectangular accommodating cavity is defined by the container body soleplate, the front enclosure plate, the rear enclosure plate, the left enclosure plate and the right enclosure plate. The cover covers an upper opening of the accommodating cavity and is connected to the horizontal rotating shaft through a horizontal long hole provided in each of the left side surface and the right side surface of the cover. The loaded pallet container is easy to transport, and has high strength, a cover that is easy to open and close, and a container body that is conveniently assembled and disassembled.

9 Claims, 3 Drawing Sheets

(52) U.S. Cl.
CPC ..... *B65D 2519/00661* (2013.01); *B65D 2519/00731* (2013.01)

(56) References Cited

U.S. PATENT DOCUMENTS 5,150,806 A * 9/1992 Glomski ..... B65F 1/1646 220/815
5,762,222 A * 6/1998 Liu ..... B65D 19/12 206/512
8,322,566 B2 * 12/2012 Hackett ..... B65D 7/16 206/1.5

* cited by examiner

LOADED PALLET CONTAINER

TECHNICAL FIELD OF THE INVENTION

The present invention relates to a container, in particular to a loaded pallet container having a cover easy to open and close and a container body convenient in disassembly and assembly, and being easy in storage and transportation.

BACKGROUND OF THE INVENTION

A pallet container or storage box having a loading function is mainly used for receiving goods in the storage and logistics industry, and when in use, required to be transported to the site for loading. At present, a commercially available loaded pallet container is generally a fixed container body structure made of wood or iron, and has a large volume; as it is impossible to disassemble such a loaded pallet container, the transportation is very inconvenient; and the cover is required to be disassembled completely during loading and unloading, this consumes both time and labor.

Chinese Patent CN203714508U, titled "CONTAINER", disclosed a container including a base frame; the base frame includes bottom side beams positioned on two sides of the bottom of the container, respectively; a bottom cross beam is positioned between the bottom side beams; floors are paved above the bottom cross beam and longitudinally extend along the container, wherein the floors include at least one steel floor and a plurality of wood floors alternatively arranged along the container in a horizontal direction, and the size of each of the wood floors in the horizontal direction is the same. Although such a container saves production cost because of being convenient to manufacture wood floors, it also has technical problems, such as, large volume, inconvenience in transportation due to impossibility of disassembly, complete disassembly of the cover during loading or unloading, and both time and labor consuming.

SUMMARY OF THE INVENTION

The present invention mainly provides a loaded pallet container having a cover easy to open and close and a container body convenient in disassembly and assembly. The loaded pallet container has high strength and is easy in storage and transportation. The present invention solves technical problems, such as, large volume, large difficulty in storage and transportation, complete disassembly of the cover during loading or unloading, and both time and labor consuming.

The technical problems of the present invention are solved by the following technical solution: a loaded pallet container is provided, including a rectangular container body soleplate and a front enclosure plate, a rear enclosure plate, a left enclosure plate and a right enclosure plate all vertically provided on the container body soleplate. A rectangular accommodating cavity is enclosed by the container body soleplate, the front enclosure plate, the rear enclosure plate, the left enclosure plate and the right enclosure plate together. A cover is matched and covered on an upper opening of the accommodating cavity. A horizontal rotating shaft is suspended on an outer wall surface of the front enclosure plate close to the upper opening of the accommodating cavity. A horizontal long hole is provided on a left side surface and a right side surface of the cover corresponding to two ends of the horizontal rotating shaft, respectively. The cover is connected to the horizontal rotating shaft through the horizontal long hole. By vertically fixing, along each side, the front enclosure plate, the rear enclosure plate, the left enclosure plate and the right enclosure plate on an upper surface of the rectangular container body soleplate to enclose a rectangular accommodating cavity, and covering the cover on the upper opening of the accommodating cavity, such a combined mounting mode allows for high strength, and easy assembly and disassembly; and after disassembly, the container may be stacked for storage and transportation, which saves the space for storage and transportation. As a rear side edge of the cover is rotationally connected to the horizontal rotating shaft through the horizontal long hole, the horizontal long hole is flipped to be in the longitudinal direction when the cover is flipped upward and opened completely. At this moment, due to its gravity, the cover automatically slides downward along the horizontal rotating shaft. The distance between the horizontal rotating shaft and the rear side edge of the cover increases, and the cover is tilted back so that rim of the rear side edge of the cover is resisted against the outer wall surface of the rear enclosure plate, in order to flip and position the cover at a set safe elevation angle. The cover is flipped inversely when the cover is closed. This operation saves both time and labor, and it is convenient to open and close the cover.

Preferably, a bottom edge of each of the front enclosure plate and the rear enclosure plate horizontally extends outward to form a lower flange; a bottom edge and two side edges of each of the left enclosure plate and the right enclosure plate horizontally extend outward to form a side enclosure plate lower flange and side enclosure plate side flanges; the lower flange is horizontally resisted against the side enclosure plate lower flange on a corresponding upper surface of the container body soleplate and kept in flexible connection thereto; and the side enclosure plate side flanges are horizontally resisted against corresponding inner side surfaces of the front enclosure plate and the rear enclosure plate and kept in flexible connection thereto. The front enclosure plate and the rear enclosure plate are butted with the left enclosure plate and the right enclosure plate after being resisted against thereto, and the four enclosure plates are butted with the container body soleplate after being resisted against thereto. In this way, both the stability of assembly and the resistance to horizontal deformation are improved, and left and right jointing members of the enclosure plates are firm and less likely to get deformed; meanwhile, the side enclosure plates, as a support of the front enclosure and the rear enclosure plate, effectively offset the tension during the assembly, so that the enclosure plate members are firm and less likely to get deformed.

More preferably, seals are sandwiched between the lower flange and side enclosure plate lower flanges and the corresponding upper surface of the container body soleplate. The seals ensure the sealing performance of a joint of the container body soleplate.

Preferably, a top edge of each of the front enclosure plate, the rear enclosure plate, the left enclosure plate and the right enclosure plate extends outward to form an upper flange; and a lower surface of the cover is horizontally resisted against an upper surface of the upper flange when the cover is closed. The upper flange edge stabilizes a junction of the enclosure plates, and meanwhile avoids rainwater from infiltrating into the container along the joint of the enclosure plates and the container body. As a result, the water resistance performance of the container body is improved.

More preferably, a buffer is provided on an inner side surface of the cover corresponding to the upper flange. The buffer may avoid rigid collision of the cover with the edges of the enclosure plates when the cover is closed, and meanwhile, the sealing performance of the cover is improved when the cover is closed.

Preferably, a bottom edge of the cover corresponding to the horizontal rotating shaft is resisted against a corresponding outer wall surface of the rear enclosure plate below the horizontal rotating shaft when the cover is completely opened, and an angle of opening of the cover ranges from 95° to 105°. When the angle of opening ranges from 95° to 105°, the space for opening the cover is saved and it is ensured that the cover will not close automatically when opened. This is safe and reliable.

Preferably, a U-shaped lock cylinder is provided on an outer wall surface of the front enclosure plate close to the opening of the accommodating cavity, the U-shaped lock cylinder horizontally extends between a front side surface of the cover and the outer wall surface of the front enclosure plate, and a lock hole is provided on a front side surface of the cover corresponding to the U-shaped lock cylinder. A front side of the cover extends forward to form a waterproof rim, and a hole is formed on the waterproof rim to form a lock hole which corresponds to the U-shaped lock cylinder secured on the front enclosure plate of the container body, thus a lock structure of the cover and the container body is formed, so that a user may select to use a ring latch integrated with a locking function.

More preferably, the U-shaped lock cylinder is inserted into the lock hole, when the cover is pushed to slide backward horizontally after the cover is closed. As the cover is rotationally connected to the horizontal rotating shaft through the horizontal long hole, the cover is pulled to slide forward horizontally after the cover is closed so that the U-shaped lock cylinder on the front enclosure plate corresponds to the lock hole on the waterproof rim; and then, the cover is pushed to slide backward horizontally so that the U-shaped lock cylinder is matched and inserted into the lock hole to lock the cover. This design is artful, saves both time and labor, prevents the cover from opening automatically when some accidents such as the rollover of the container body occur, and ensures that items in the container body will not fall out from the container body. As a result, the security of use is improved.

Preferably, the container body soleplate is fixedly connected to the front enclosure plate, the rear enclosure plate, the left enclosure plate, and the right enclosure plate through a number of bolts; the left enclosure plate and the right enclosure plate are fixedly connected to the front enclosure plate and the rear enclosure plate through a number of bolts; and the bolts, corresponding to two ends of each group of butting edges, are close to a corresponding corner. Connection by bolts is convenient for assembly and disassembly; the bending strength of a right-angled flange may be used adequately when the bolts are secured at corners close to the enclosure plates, so that each of the enclosure plates will be free of opening or deformation after assembly to influence the sealing performance of the container body. Thereby, the size and the operational performance of the container body are ensured.

Preferably, U-shaped supporting feet are provided on two sides of the bottom surface of the container body soleplate, or rollers are provided at corners of the bottom surface of the container body soleplate. The U-shaped supporting feet are arranged on the container body soleplate to play a role of supporting, i.e. a function of storing, transporting and moving a pallet; and meanwhile, the U-shaped supporting feet are suitable for transporting by a forklift; and rollers may be arranged on the bottom surface of the container body soleplate so that the container body supports sliding, which is convenient for transportation.

Therefore, the loaded pallet container of the present invention has the following advantages: a hexagonal structure of the container body is spliced by a unified positioning hole and bolts, has a high strength and is easy for disassembly and assembly; the volume of a bulk package is about 20% of that of a finished product before assembly, as a result, the transportation cost is reduced and the structure of the container body is simplified; meanwhile, an opening function and an automatic locking function of the cover is improved, which is convenient, safe and reliable when in use; and seals or buffers made of PU foam sheets are stuck on contact surfaces of the hexahedron, the seals or buffers form a waterproof structure of the entire container body together with a waterproof structure of the waterproof rim, thereby guaranteeing excellent sealing performance. With the U-shaped supporting sheet and rollers on the bottom of the container body, it is convenient to transport by a forklift or transport in a slide manner.

DETAILED DESCRIPTION OF THE INVENTION

A technical solution of the present invention will be further described specifically by embodiments and with reference to the drawings.

Embodiment 1

Figure 1:
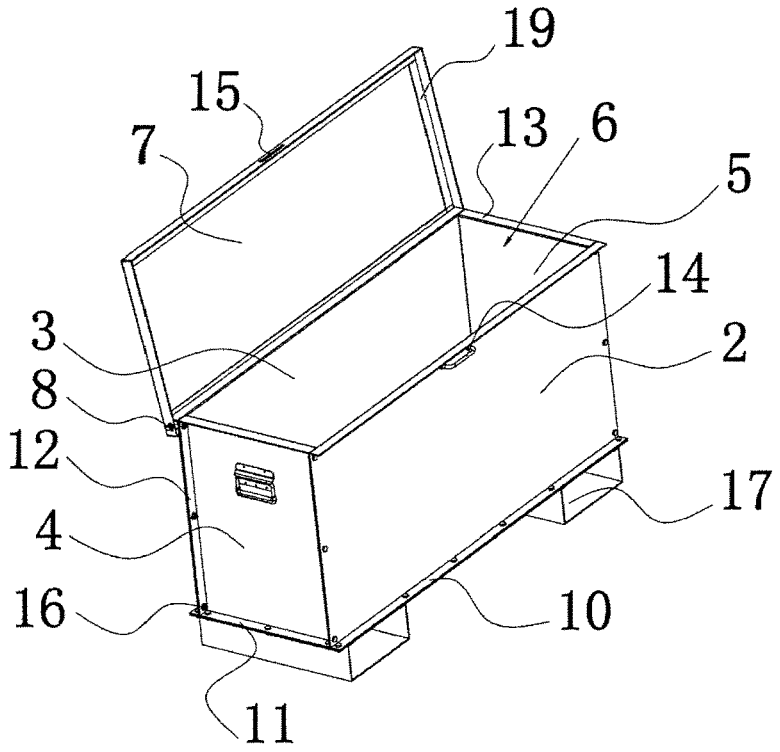
FIG. 1 is a stereoscopic diagram of a loaded pallet container according to the present invention in one direction.
Figure 2:
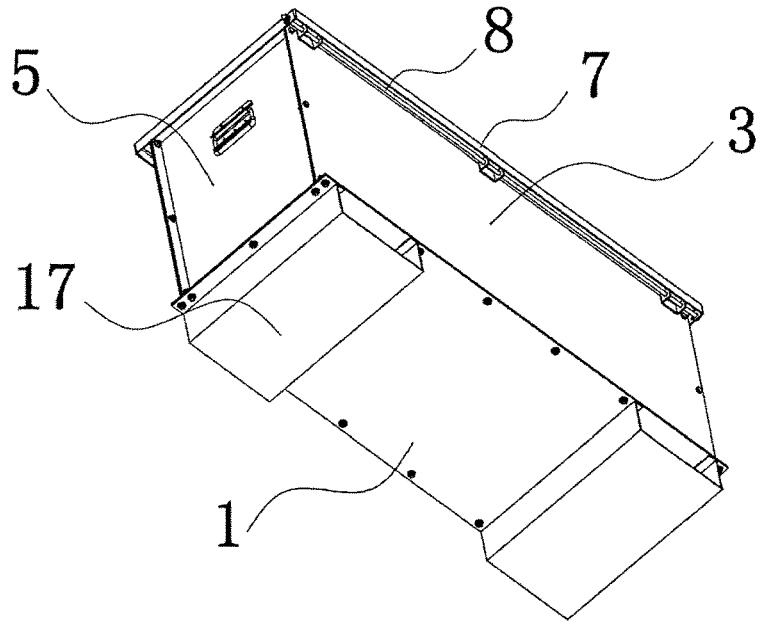
FIG. 2 is a stereoscopic diagram of the loaded pallet container according to the present invention in another direction.
Figure 3:
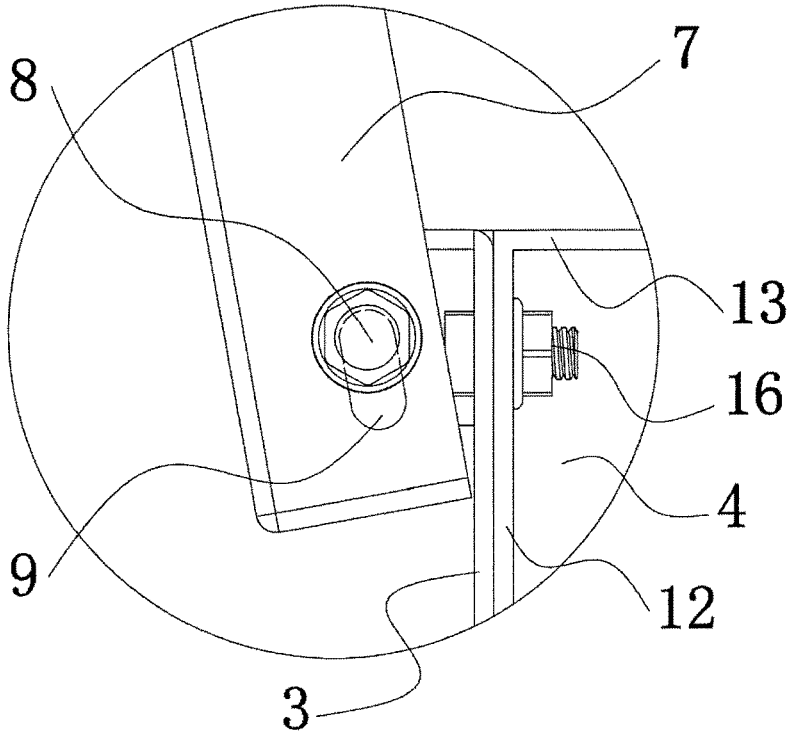
FIG. 3 is a partially schematic structure diagram according to the present invention, when a cover is opened completely.
Figure 4:
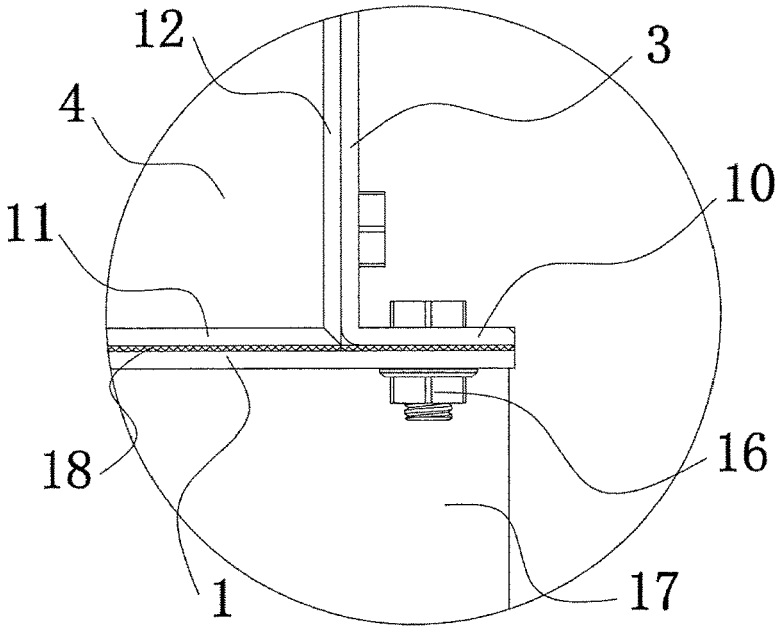
FIG. 4 is an enlarged view of a junction of a container body soleplate and a rear enclosure and a left enclosure plate according to the present invention.
Figure 5:
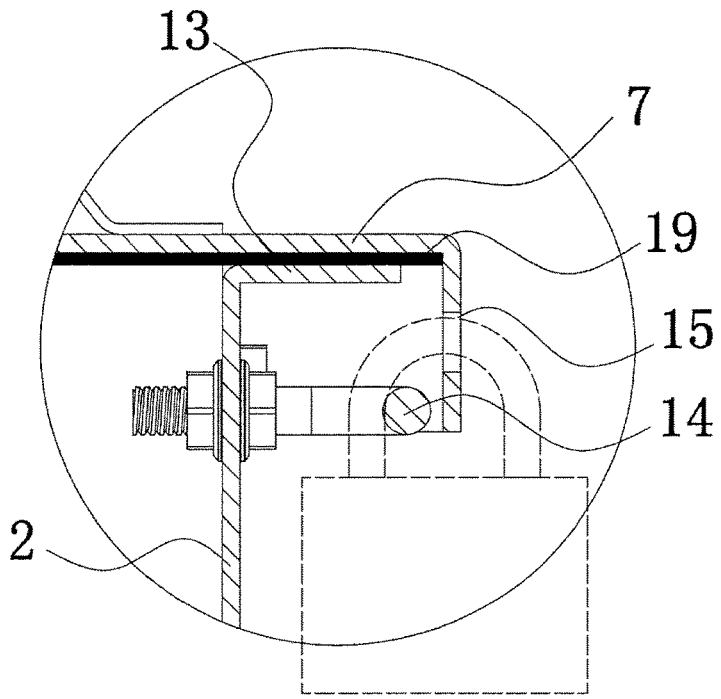
FIG. 5 is a sectional view according to a first implementation of the present invention, when a U-shaped lock cylinder is matched with a lock hole.
Figure 6:
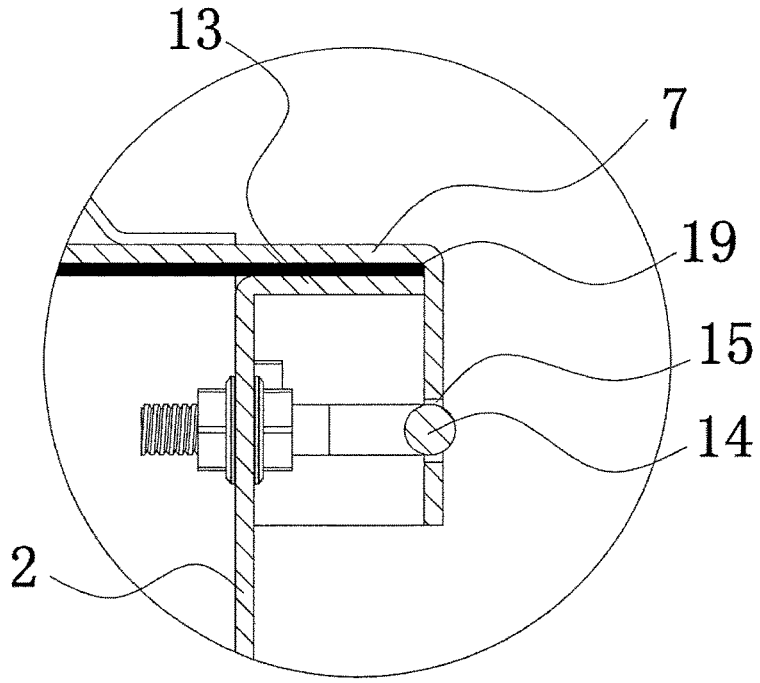
FIG. 6 is a sectional view according to a second implementation of the present invention, when the U-shaped lock cylinder is matched with the lock hole.

As shown in FIG. 1, a loaded pallet container of the present invention is provided, including a rectangular container body soleplate 1. U-shaped supporting feet 17 are secured on two sides in a direction of the length of a bottom surface of the container body soleplate 1. A front enclosure plate 2, a rear enclosure plate 3, a left enclosure plate 4 and a right enclosure plate 5 are all vertically secured on rims of four edges of an upper surface of the container body soleplate 1, correspondingly. A rectangular accommodating cavity 6 is enclosed by the container body soleplate 1, the front enclosure plate 2, the rear enclosure plate 3, the left enclosure plate 4 and the right enclosure plate 5 together. A cover 7 is matched and covered on an upper opening of the accommodating cavity 6. The container body soleplate 1, the front enclosure plate 2, the rear enclosure plate 3, the left enclosure plate 4, the right enclosure plate 5 and the cover 7 are made of aluminum alloy profiles. A bottom edge of each of the front enclosure plate 2 and the rear enclosure plate 3 horizontally extends outward to form a lower flange 10. A bottom edge and two side edges of each of the left enclosure plate 4 and the right enclosure plate 5 horizontally extend outward to form a side enclosure plate lower flange 11 and side enclosure plate side flanges 12. The lower flange 10 is horizontally resisted against on a corresponding upper surface of the container body soleplate 1 and is in fixed connection thereto by six bolts 16. The lower enclosure plate side flanges 11 are horizontally resisted against a corresponding upper surface of the container body soleplate 1 and are in fixed connection thereto by three bolts 16. The side enclosure plate side flanges 12 are horizontally resisted against corresponding inner side surfaces of the front enclosure plate 2 and the rear enclosure plate 3 and are in fixed connection thereto by three bolts 16. And, the bolts 16, corresponding to two ends of each group of butting edges, are close to a corresponding corner. As shown in FIG. 4, seals 18 made of PU foam sheets are sandwiched between the lower flange 10 and side enclosure plate lower flanges 11 and the corresponding upper surface of the container body soleplate 1. A top edge of each of the front enclosure plate 2, the rear enclosure plate 3, the left enclosure plate 4 and the right enclosure plate 5 extends outward to form an upper flange 13. As shown in FIG. 2, a horizontal rotating shaft 8 is suspended on an outer wall surface of the rear enclosure plate 3 close to the upper opening of the accommodating cavity 6 through three U-shaped supporting plates. As shown in FIG. 3, a horizontal long hole 9 is provided on a left side surface and a right side surface (waterproof rims) of the cover 7 corresponding to two ends of the horizontal rotating shaft 8, respectively. The cover 7 is rotationally connected to the horizontal rotating shaft 8 through the horizontal long hole 9. A bottom edge of the cover 7 corresponding to the horizontal rotating shaft 8 is resisted against a corresponding outer wall surface of the rear enclosure plate 3 below the horizontal rotating shaft 8 when the cover 7 is completely opened and an angle of opening of the cover 7 is 100°. The upper surface of the cover 7 is horizontally resisted against the upper surface of the upper flange 13 when the cover 7 is closed downward. As shown in FIG. 1, FIG. 5 and FIG. 6, a buffer 19 made of PU foam sheets is stuck on an inner side surface of the cover 7 corresponding to the upper flange 13. A U-shaped lock cylinder 14 is horizontally secured on an outer wall surface of the front enclosure plate 2 close to the opening of the accommodating cavity 6, two ends of the U-shaped lock cylinder 14 are secured firmly by nuts after horizontally passing through the front enclosure plate 2, so that the U-shaped lock cylinder 14 is positioned between a front side surface of the cover 7 and the outer wall surface of the front enclosure plate 2. A rectangular lock hole 15 is formed on a front side surface of the cover 7 corresponding to the U-shaped lock cylinder 14. As shown in FIG. 5, a ring latch is assembled by passing through the lock hole 15 and the U-shaped lock cylinder 14.

Embodiment 2

As shown in FIG. 6, the U-shaped lock cylinder 14 is matched and inserted into the lock hole 15, when the cover 7 is pushed to slide backward horizontally after the cover 7 is closed, and a roller is mounted at a corner of the bottom surface of the container body soleplate 1, respectively. The remaining is completely the same as Embodiment 1.

Embodiment 3

U-shaped supporting sheet 17 are symmetrically secured on two sides in a direction of the length of the bottom surface of the container body soleplate 1, and a roller is mounted on a U-shaped supporting foot 17 corresponding to a corner of the bottom surface of the container body soleplate 1, respectively. The remaining is completely the same as Embodiment 2.

The embodiments described herein are merely examples of the concept of the present invention. For those skilled in the art to which the present invention pertains, various modifications or supplements or replacements in a similar way may be made to the described specific embodiments, without departing from the spirit of the present invention or going beyond a range defined by the appended claims.

The invention claimed is:

1. A loaded pallet container, comprising:

a rectangular container body soleplate;

a front enclosure plate, a rear enclosure plate, a left enclosure plate, and a right enclosure plate, wherein the front enclosure plate, rear enclosure plate, left enclosure plate, and right enclosure plate are vertically disposed on the container body soleplate;

a rectangular accommodating cavity defined by the container body soleplate, the front enclosure plate, the rear enclosure plate, the left enclosure plate, and the right enclosure plate;

a cover being matched with and covering an upper opening of the accommodating cavity; and a horizontal rotating shaft suspended on an outer wall surface of the rear enclosure plate close to the upper opening of the accommodating cavity, wherein a horizontal long hole is provided on a left side surface and a right side surface of the cover corresponding to two ends of the horizontal rotating shaft, respectively, and the cover is rotationally connected to the horizontal rotating shaft through the horizontal long holes, a bottom edge of each of the front enclosure plate and the rear enclosure plate horizontally extends outward to form a lower flange, a bottom edge and two side edges of each of the left enclosure plate and the right enclosure plate horizontally extend outward to form a side enclosure plate lower flange and side enclosure plate side flanges, and the lower flange is horizontally resisted against the side enclosure plate lower flange on a corresponding upper surface of the container body soleplate and kept in flexible connection thereto, and the side enclosure plate side flanges are horizontally resisted against corresponding inner side surfaces of the front enclosure plate and the rear enclosure plate and kept in flexible connection thereto.

2. The loaded pallet container according to claim 1, wherein seals are sandwiched between the lower flange and side enclosure plate lower flanges and the corresponding upper surface of the container body soleplate.

3. The loaded pallet container according to claim 1, wherein a top edge of each of the front enclosure plate, the rear enclosure plate, the left enclosure plate and the right enclosure plate extends outward to form an upper flange, and a lower surface of the cover is horizontally resisted against an upper surface of the upper flange when the cover is closed.

4. The loaded pallet container according to claim 3, wherein a buffer is provided on the lower surface of the cover corresponding to the upper flange.

5. The loaded pallet container according to claim 1, wherein a bottom edge of the cover corresponding to the horizontal rotating shaft is resisted against a corresponding outer wall surface of the rear enclosure plate below the horizontal rotating shaft when the cover is completely opened, and an angle of opening of the cover ranges from 95° to 105°.

6. The loaded pallet container according to claim 1, wherein a U-shaped lock cylinder is provided on an outer wall surface of the front enclosure plate close to the opening of the accommodating cavity, the U-shaped lock cylinder horizontally extends between a front side surface of the cover and the outer wall surface of the front enclosure plate, and a lock hole is provided on the front side surface of the cover corresponding to the U-shaped lock cylinder.

7. The loaded pallet container according to claim 6, wherein the U-shaped lock cylinder is inserted into the lock hole, when the cover is pushed to slide backward horizontally after the cover is closed.

8. The loaded pallet container according to claim 1, wherein the container body soleplate is fixedly connected to the front enclosure plate, the rear enclosure plate, the left enclosure plate, and the right enclosure plate through a number of bolts, and the left enclosure plate and the right enclosure plate are fixedly connected to the front enclosure plate and the rear enclosure plate through a number of bolts, and each of the bolts is located close to a corresponding corner of one of the front enclosure plate, the rear enclosure plate, the left enclosure plate, and the right enclosure plate that said bolt fixedly connects.

9. The loaded pallet container according to claim 1, wherein U-shaped supporting feet are provided on two sides of a bottom surface of the container body soleplate.

* * * * *